US006074308A

United States Patent [19]

Domas

[11] Patent Number: 6,074,308

[45] **Date of Patent: *Jun. 13, 2000**

[54] GOLF CLUB WOOD HEAD WITH OPTIMUM AERODYNAMIC STRUCTURE

[76] Inventor: Andrew A. Domas, 105 Twin Oaks Dr., Suite 302, Joliet, Ill. 60431

[ * ] Notice: This patent is subject to a terminal disclaimer.

[21] Appl. No.: 09/200,901

[22] Filed: Nov. 24, 1998

Related U.S. Application Data

[63] Continuation of application No. 08/752,195, Feb. 10, 1997.

[51] Int. Cl.[7] ..... A63B 53/04

[52] U.S. Cl. ..... 473/327; 473/349

[58] Field of Search ..... 473/324, 327, 473/328, 344, 349, 345, 346, 347, 348, 228, 350, 282; D21/733

[56] References Cited

U.S. PATENT DOCUMENTS

| | | |
|---|---|---|
| 3,815,910 | 6/1974 | Raines . |
| 3,997,170 | 12/1976 | Goldberg . |
| 4,065,133 | 12/1977 | Gordos . |
| 4,139,196 | 2/1979 | Riley . |
| 4,319,752 | 3/1982 | Thompson . |
| 5,190,290 | 3/1993 | Take . |
| 5,456,469 | 10/1995 | MacDougall . |
| 5,467,989 | 11/1995 | Good . |

*Primary Examiner*—Sebastiano Passaniti

*Attorney, Agent, or Firm*—Joanne Denison; Denison & Assoc, PC

[57] ABSTRACT

The present invention consists of an improved golf club head design for a golf club in wherein in one preferred embodiment the club head is preferably molded from a clear acrylic material or polymeric material or a high tech metal alloy wherein a plurality of elongated elliptical or v-shaped gently flaring grooves or indentations extend normal to the club head striking surface and are embedded in at least the crown and sole of the club head. These grooves may be present in the toe surface in larger club heads, such as drivers. These grooves initiate from just behind the striking face or leading edge and extend rearwardly toward the back of the club wood head. The grooves create a corresponding plurality of vortices during the golf swing which redirect and accelerate air flow rearwardly away from the back of the club head, reducing wind resistance and eliminating induced drag of the moving club head, thereby increasing thrust which in turn increases the overall distance a golf ball is capable of traveling during a given shot. In one preferred embodiment of the invention, a metal housing or shell is provided with an acrylic insert to achieve increased performance and durability.

11 Claims, 8 Drawing Sheets

GOLF CLUB WOOD HEAD WITH OPTIMUM AERODYNAMIC STRUCTURE

This application is a continuation in part of copending application Ser. No. 08/752,195, filed Feb. 10, 1997.

FIELD OF THE INVENTION

The present invention relates to the field of golf clubs, and in particular, to golf club wood heads (commonly known as the No. 1 wood or driver, as well as the Nos. 2, 3, 4, etc.), and even putters and other assorted club heads. Specifically, this particular field of golf club head design utilizes certain aerodynamic structural improvements by providing aerodynamic, gently curving indentations in the crown, sole and, space permitting toe surfaces of a golf club wood head which result in performance enhancement.

BACKGROUND OF THE INVENTION

A traditional golf club head is inherently wind resistant due to the nature of its flat face on the leading edge of the swing, and its somewhat rounded body. This results in a greatly reduced club head velocity during a golf down swing. Although there are numerous known club head structures and designs disclosed in the prior art, such as the Sinclair patent, U.S. Pat. No. 4,900,029 which discloses the use of a golf club head with a singular large top vertical air foil cavity; the Gordos patent, U.S. Pat. No. 4,065,133, which discloses the use of an aerodynamic upper surface containing a plurality of shallow grooves normal to the club face; the Goldberg Patent U.S. Pat. No. 3,997,170; which discloses the use of a plurality of parallel grooves formed in the upper or top face of a golf club wood head which are normal to the striking face and are used for the purpose of visually indicating the desired direction of the stroke; and the design patents of Chrone, U.S. Pat. No. D326,130 which shows the use of a single large v-shaped gorge along the backside of a club head; the Jansky U.S. Pat. No. D94,549 which shows two opposing lateral v-shaped grooves in the underside of a club head; and Jansky U.S. Pat. No. D944,550 which shows the use of a single lateral v-shaped groove in the underside of a club head; and Duaguard U.S. Pat. No. D332,476 which shows the use of a single v-shaped forge along the front face of a club head, none of the aforementioned prior art disclosures teach an improved golf club wood head containing all of the features and advantages of the present invention.

In playing the game of golf, it is not brute physical power in a golfer's swing that determines the ultimate distance a golf ball is capable of traveling. It is the amount of club head velocity a golfer can generate during an arcuate down stroke of the golf swing. Therefore, by properly embedding curved surfaces into a golf club head body, this increases air velocity around the golf club head body, especially into and through the vortices, hence decreasing resistance and drag, thereby increasing the speed of the club before it strikes the ball, resulting in increased flight distance traveled by the ball.

SUMMARY OF THE INVENTION

The present invention consists of the strategic location of vortex generators or elongated indentations in the body of a golf club head. In the case of the present invention, in one preferred golf wood head embodiment, five vortex generators are located on the surface of the golf club head; two in the top or crown of the club head, two in the toe portion of the club head, and the last, or fifth single vortex generator is centrally positioned in the sole or underside of the golf club head. These five vortex generators or indentations are represented as depressions or embedments into the golf club head. The two crown vortex generators begin at a point just rear of the striking face or leading edge of the club head and flare outwardly as they extend toward the back of the golf club head. They follow the normal body contour of the club head. The two toe vortex generators begin at a point somewhat closer to the leading edge or face line and extend parallel to one another toward the rear of the club head toe and terminate at the point just therebefore. The single sole or underside vortex generator begins at a point just rear of the ball striking face or leading edge of the golf club head and flares outwardly as it extends toward the back of the club head. All of the aforementioned vortex generators are consistent in depth along their length.

During an arcuate golf downswing, the club face and body creates pressure on the air in front of the leading edge or front of the golf club head which disrupts the static stability of the air. During the continuum of the down swing, the pressure of the air in front of the club face converts the static stability into dynamic stability of the same disturbed and pressured air, forcing the air to flow over the crown or top, under the sole and around the toe and heel of the club head. As the air flow over the crown begins to pass over the openings therein of the vortex generators or indentations, the naturally occurring boundary layer of air is disrupted, creating a vortex and forming a vacuum that draws the air flow into each of the said vortex generators at an accelerated speed, forcing that accelerated air flow through said vortex generators and directing the faster moving air out of the aforementioned rearward open terminal ends of the club head. This accelerated air flow into and through the two crown vortex generators would normally produce forward and upward lift forces on the club head throughout the duration of the arcuate motion of the down swing.

The resultant forward and upward forces created by the crown vortex generators, in addition to the counterbalancing and other forces described below, follow the laws of aerodynamics wherein certain components changing or redirecting the natural air flow direction are capable of producing significant increases in force on any moving body passing through air, much similar to the mechanism by which a curved wing produces lift.

In this case, however, the sole vortex generator positioned in the underside of the club head creates similar but forward and downward force on the club head which counterbalances the upward forces created by the dual crown vortex generators. Thus, the dynamic stability of the dual crown and single underside vortex generators, by offsetting the downward and upward lift forces present on the golf club head, focuses entirely on the forward forces created by both the crown and underside vortex generators, resulting in a net increase in force upon the golf head which is actually greater than that created by normal drag on a golf club head during an arcuate downswing.

In addition to this effect, the dual toe vortex generators serve three distinct functional advantages as a result of the accelerated airflow into and through these embedments: 1) additional forward thrust, 2) promotion of a truer flight plane during the down swing, and 3) lateral thrust away from the toe and toward the rear of the golf club head which assist in promoting an inside out down swing plane.

Therefore, during a golf down swing, the aerodynamic forces created by the vortex generators in the crown, underside and toe, where space is available, create a net forward thrust which is proportional to the amount of club head velocity produced by a golfer of any skill level. These vortices create a net forward thrust sufficient to overcome naturally occurring wind resistance and induced drag present during the use of more conventionally shaped golf club heads. By harmoniously harnessing the static and dynamic stability of air flow around, into and through the vortex generators, optimum aerodynamic advantage is achieved through the generation of greater golf club head velocity during any arcuate down swing, ultimately resulting in a measurable improvement of the overall distance a golf ball will travel.

An additional benefit of the multiple vortex driver is that it provides a self-correcting mechanism for off center ball strikes. By the strategic location of the vortex generators in the crown, underside and toe, the displace weight is naturally redistributed toward the toe and heel of the club, with a greater amount of weight falling in the vicinity of the toe. The heel area, on the other hand, is adapted for attachment to a shaft which transmits the driving power during a down swing. Because the golf club head is heavier in the area of the toe, it is better balanced during a swing, when the heel portion is transmitting the main driving force of the swing. Thus, the present invention results in a more balanced strike of the ball due to a balanced weight and power distribution system that can measurably narrow the shot dispersion pattern and markedly improve overall accuracy, especially when this feature is combined with the aerodynamic net forward thrust also created by the quintuple vortex generators of this preferred embodiment as well as the modified embodiments described below.

It is important to note that it would be very inadvisable to position a vortex generator into the heel or anywhere adjacent to the shaft mounting area at the hosel to the sole on the heel side of the club head wood, especially on standard or mid-sized golf club wood heads. The decrease in material in this portion of the club head could cause the club head to shatter upon impact at or around the heel area. Conversely, it may be possible to position a vortex generator into the heel of a jumbo wood head, as a jumbo wood head may have sufficient structural support to accommodate the resultant decrease in material present.

Because of size constraints on smaller headed, higher lofted golf club heads, such as the No. 5, No. 7 and No. 9 fairway woods, such smaller, more naturally streamlined golf club wood heads may require a simplified multiple vortex generator system: either a single vortex generator indentation embedded into the crown, sole and toe, toe surface permitting; or, the toe vortex generator may be repositioned proportionately to the crown and/or sole of the golf club head with two similar, essentially parallel and proportionate vortex generator embedments in the crown with a single vortex generator indentation in the sole, or vice versa. The necessary repositioning eliminates potential structural weaknesses at or about limited golf club head toe surfaces, thereby providing the same forward force focus, aerodynamic and physical advantages as the first preferred embodiment described herein. Conversely, multiple vortex generator systems, or multiple indentation embedments may be strategically positioned within each of the actuatable surfaces of the crown, sole, toe, and possibly even the heel, where jumbo size heads allow for structural integrity, providing similar or greater aerodynamic and physical benefits.

While the optimum aerodynamic and physical advantages of the present invention may be achieved when applied to hollow bodied shell steel club heads, composite graphite club heads, and light weight aluminum/titanium alloy club heads, all of which are commonly available in the market place today, the preferred material for the present invention would consist of a solid body construction of heavier resinous or polymeric compounds of considerable density. It is a basic law of physics that solid body constructions retain greater potential energy compared with their hollow bodied equivalent structures. It is this physical principal which would result in a more explosive release of the golf ball when it is struck with the golf club head described herein. In one preferred embodiment of the present invention, the durability and wear resistance of a light weight, high strength metal alloy shell is combined with the energy absorbing potential of acrylics and other resinous copolymers by providing a solid body copolymer interior molded entirely thereinto an outer metal shell. Of course, it is possible to make the present invention from an acrylic molded material which has an extremely high capacity to quickly store and release potential energy, but it has been noticed that acrylic and other copolymers are easily scratched, which is not only unattractive to the golf club owner, but may result in imbalance and improper performance with repeated scratching on sand based driving ranges and golf courses, as well as natural impediments such as rocks, tree stumps, etc., removing material from the golf club head, compounded by the cleaning process to remove such scratches, nicks and chip marks. Thus, it is highly desirable, in one preferred embodiment of the present invention, to create an acrylic or other copolymeric, resinous insert which is directly and easily molded into the interior of a steel or aluminum/titanium alloy shell resulting in a superior golf club head with superior performance and scratch resistance.

OBJECTS OF THE INVENTION

Thus, it is a primary object of the present invention to provide a golf club head design which effectively and harmoniously harnesses the naturally occurring aerodynamic forces created during a golf club down swing.

It is a further primary object of the present invention to provide such a golf club head design without sacrificing the visually classic appearance, at address and throughout the golf swing, which is most widely accepted by generations of golfers of all skill levels.

It is a further primary object of the present invention to provide a multiple vortex generator golf club head system which results in a net thrust of additional force generated during an arcuate golf down swing that is capable of producing greater flight of the ball.

It is yet another primary object of the present invention to provide a multiple vortex generator golf club head system which concentrates the greater weight of the golf wood head near the toe of the club, resulting in a more accurate swing that is less sensitive to off center strikes.

It is yet another primary object of the present invention to provide a golf club wood head which has vortex generators consisting of gently curving indentations present in the crown, sole and space permitting, toe portion of the golf club wood head wherein these gently curving indentations act as an airfoil does, creating net lift and thrust on the body of the golf club wood head.

It is yet another primary object of the present invention to utilize a golf club head body which is composed of acrylic or other suitable copolymer which is capable of storing and quickly releasing high levels of potential energy during the striking of a golf ball creating a greater impact on the boll with less swing power and speed.

It is yet another primary object of the present invention to utilize a golf club wood head with an acrylic or other suitable copolymeric solid body interior with an outer layer or shell comprised of steel or aluminum/titanium alloy which provides superior durability and wear and scratch resistance during repeated use by a golfer.

It is yet another primary object of the present invention to utilize a golf club head body having embedments or vortex generators in the sole, crown and toe, space permitting, which is made entirely of titanium, steel or other high tech metal or graphite alloy for durability and strength.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
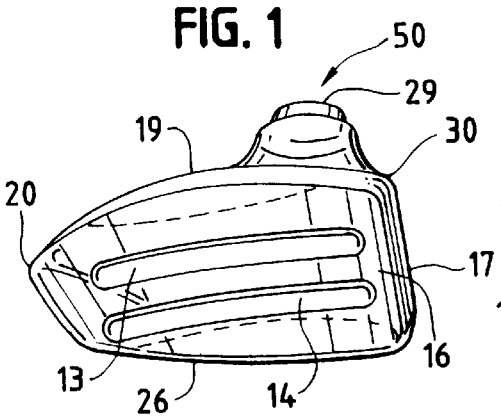
FIG. 1 is a toe or front elevation of a No. 1 wood or driver golf club wood head with two vortex generators positioned in the toe portion of the golf club wood head which comprises a first preferred embodiment of the present invention.

Referring to FIGS. 1 through 4, these figures show a first preferred embodiment of the present invention wherein a golf club wood head 50 is provided with five vortex generators positioned normal to the striking face 17. FIG. 1 shows golf club wood head 50 in elevational end view detailing the location of the vortex generators 13 and 14 is as follows: overall lengths are 2.050 inches; overall widths are 0.10 inches; height of toe 16 from underside 26 to crestline 30 is 1.40 inches.

Figure 2:
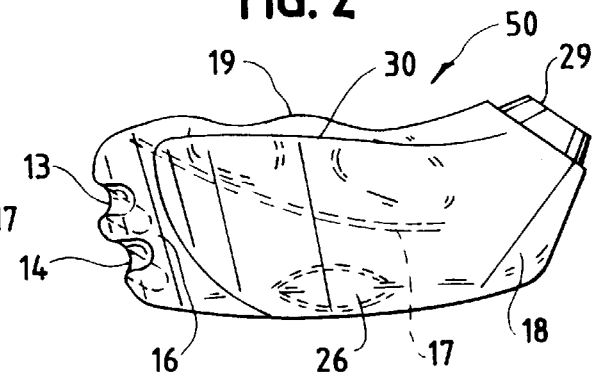
FIG. 2 is a left side elevation view of the first preferred embodiment of the present invention.

FIG. 2 shows an elevational view of the golf club wood head 50 wherein striking face 17 is shown in full view. Vortex generators or indentations 13 and 14 are now shown in side view along toe 16. A preferable dimensioning is as follows: overall length from toe 16 to heel 18 is 4.175 inches; underside 26 length is 3.350 inches; overall height from underside 26 to crown 19 apex is 1.50 inches; striking face 17 height from underside 26 to crestline 30 is 1.40 inches.

Figure 3:
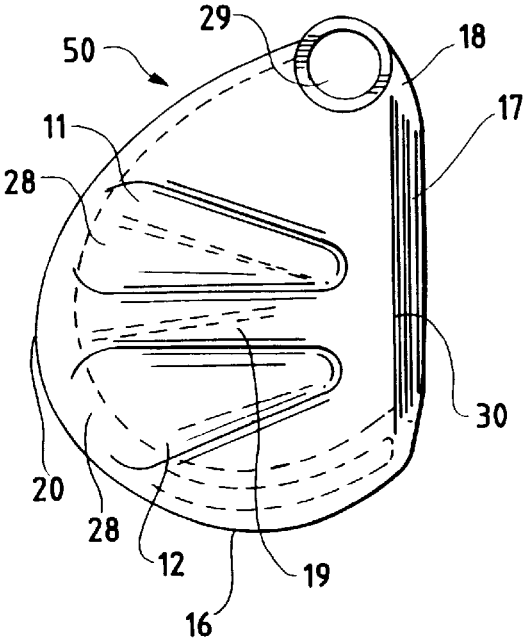
FIG. 3 is a crown plan view of the first preferred embodiment of the present invention showing two vortex generators positioned in the crown of the golf club wood head body.

FIG. 3 illustrates a top plan view of golf club wood head 50 showing crown 19 and crown vortex generators or indentations 11 and 12. A preferable dimensioning is as follows: overall golf club wood head length from the outward most point of shaft mounting area 29 to the apex of toe 16 is 4.175 inches; overall width from back 20 of golf club wood head 50 to the leading edge of striking face 17 is 3.725 inches; the width of each crown vortex generator or indentation 11 and 12 at the crownline 19 (there just below which is approximately the center of gravity of golf club wood head 50) is 0.975 inches, flaring rearwardly toward back 20 to open terminal ends 28.

Figure 4:
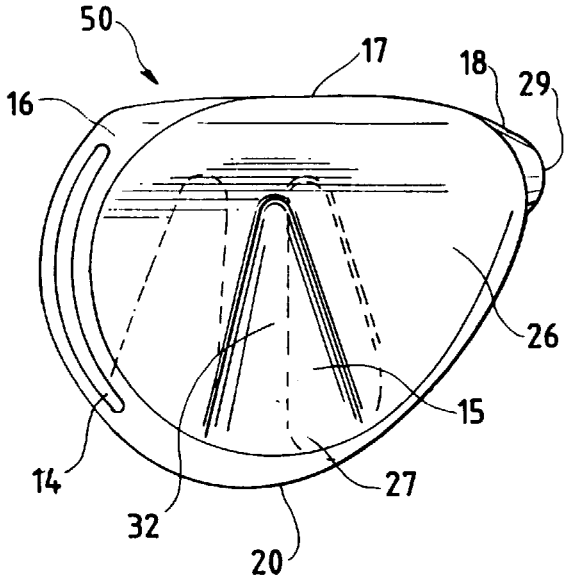
FIG. 4 is an underside or bottom plan view of the first preferred embodiment of the present invention showing the fifth vortex generator.

FIG. 4 shows a bottom plan view of the golf club wood head 50 illustrating the underside 26 and depicting, again, the preferred location and configuration of underside vortex generator or indentation 15 in underside 26, as well as its general relationship to toe vortex generator or indentation 14 near the bottom of toe 16. A preferred relative dimensioning is as follows: overall length of the underside 26 or bottom is 3.50 inches; the width of the underside 26 from the leading edge of striking face 17 to the outermost edge of open terminal end 27 consistent with the normal body contour is 2.75 inches; width of underside vortex generator or indentation 16 at the crown apex point 32, or the apex of crown 19 of golf club wood head 50 is 1.250 inches, and the depth of vortex generator or indentation 15 at the same crown apex point 32 is 0.225 inches; the leading edge or crestline 30 of striking face 17 to the crown apex point 32 is approximately 1.00 inches.

FIGS. 1 through 4 illustrate the preferred locations, depths, and dimensions of the five vortex generators or indentations as incorporated into one preferred configuration of the present invention, in this case a No. 1 wood or driver and such a configuration is especially preferred when the golf club wood head is constructed in solid body form with a resinous compound such as acrylics, or acrylic based polymers. These dimensions, depths, and locations of the vortex generators may vary; nonetheless the inventive concept disclosed herein may be adapted to hollow bodied designs such as steel, composite graphite, lightweight aluminum alloys, as well as to other recently discovered and/or applied space age materials. Minute shrinkage occurring during the manufacturing process should not be a design problem, even when molds are made to the dimensions given herein. The present invention may be even adapted to smaller, more streamlined, higher lofted fairway and or "trouble woods" such as the Nos. 7 and 9, for example, where space constraints dictate modification of the multiple vortex generator system.

Figure 5:
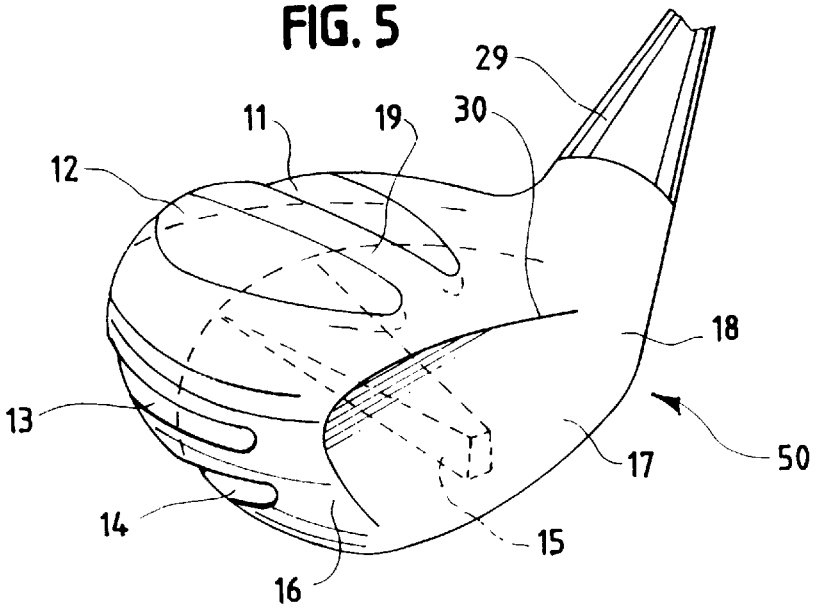
FIG. 5 is a perspective view of the first preferred embodiment of the present invention showing its aerodynamic features during a down swing.

FIG. 5 shows a perspective view of golf club wood head 50 showing all the primary elements of the crown 19 and toe 16 containing vortex generators 11, 12, 13 and 14 along the outer perimeter of the golf club wood head 50.

Figure 6:
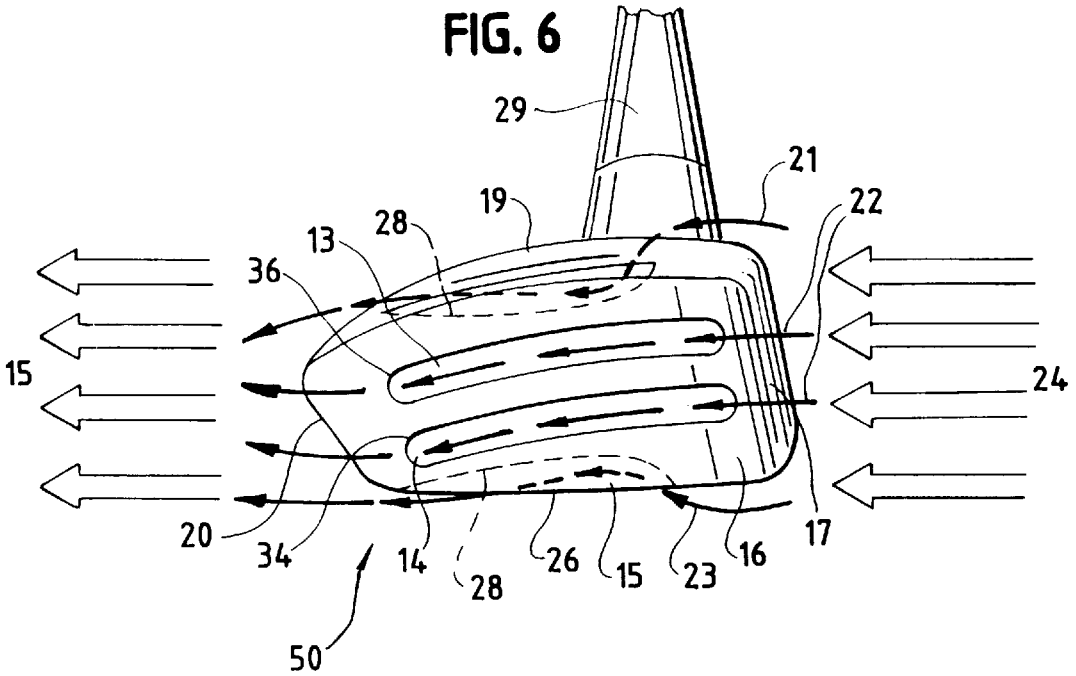
FIG. 6 is a front elevation of the first preferred embodiment of the present invention showing its aerodynamic features during a down swing.

FIG. 6 illustrates the harmonious harnessing of the aerodynamic forces acting on golf club wood head 50 during a down swing. From the top of an arcuate down swing of a golf club wood head 50, the striking face 17 of golf club wood head 50 exerts pressure (schematically indicated) on the stability of static air 24, directing the upper flow of air 21 over crown 19, the central flow of air 22 around toe 16, and the lower flow of air 23 properly around the golf club wood head 50.

As the upper flow of air 21 begins to pass over the two crown vortex generators 11 and 12, a vacuum is created. The upper flow of air 21 is drawn into crown vortex generators or indentations 11 and 12 by this vacuum, causing the flow of upper air 21 to move at a faster rate of speed than the club head, and it directs the accelerated air flow out the open terminal ends 28 of the crown vortex generators or indentations 11 and 12 at the rear 20 of golf club wood head 50. The underside vortex generator or indentation 15 draws the lower flow of air 23 into underside vortex generator or indentation 15 by means of a vacuum, accelerates the air to a speed greater than that of club head wood head 50 and then forces the lower flow of air 23 out the open terminal end 28. The two toe vortex generators or indentations 13 and 14 around toe 16, by means of a vacuum, draw the central air flow 22 into toe vortex generators or indentations 13 and 14. However, because of the closed terminal ends 34 and 36 at the rear of vortex generators or indentations 13 and 14, additional pressure is created in the area of closed terminal ends 34 and 36. Those additional lateral forces further aid the balance of the forward forces. An inwardly acting force tends to counter balance the forward forces created along the shaft mounting area 29 and heel 18 areas during the golf down swing producing a truer and straighter swing. This phenomena is especially effective when used in combination with the accelerated air flows 21, 22 and 23 drawn into vortex generators or indentations 11, 12, 13, 14 and 15 which are sufficient enough to produce a net forward thrust greater than wind resistance and drag around the golf club wood head 50 body.

It should be noted that upper flow of air 21, central flow of air 23 and lower flow of air 23 are all gently curving in nature, much like the configuration of gently curving air that passes over the gently curving surfaces of an air plane wing which is able to create a net lift and thrust when properly angled. In a similar manner, these air flow streams along the crown 19, toe 16 and underside or sole 26 are gently curving and create net lift and thrust on golf club wood head 50 to produce a faster swing such that a golfer needs much less effort to strike the ball than ever before.

Figure 7:
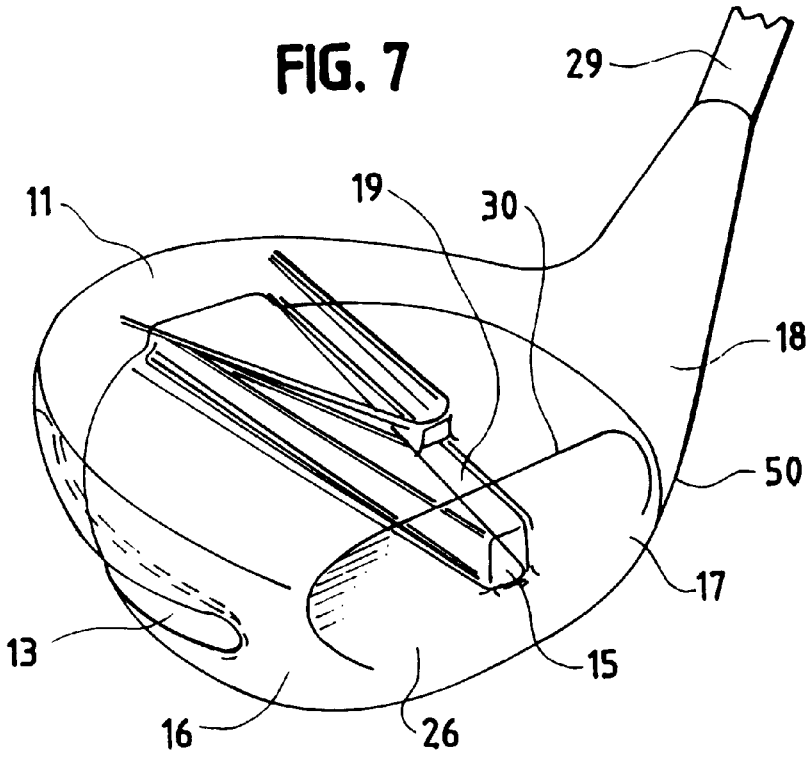
FIG. 7 is a perspective view of the simplified preferred embodiment of the present invention adapted to fairway-sized and/or more streamlined golf club head configurations.
Figure 8:
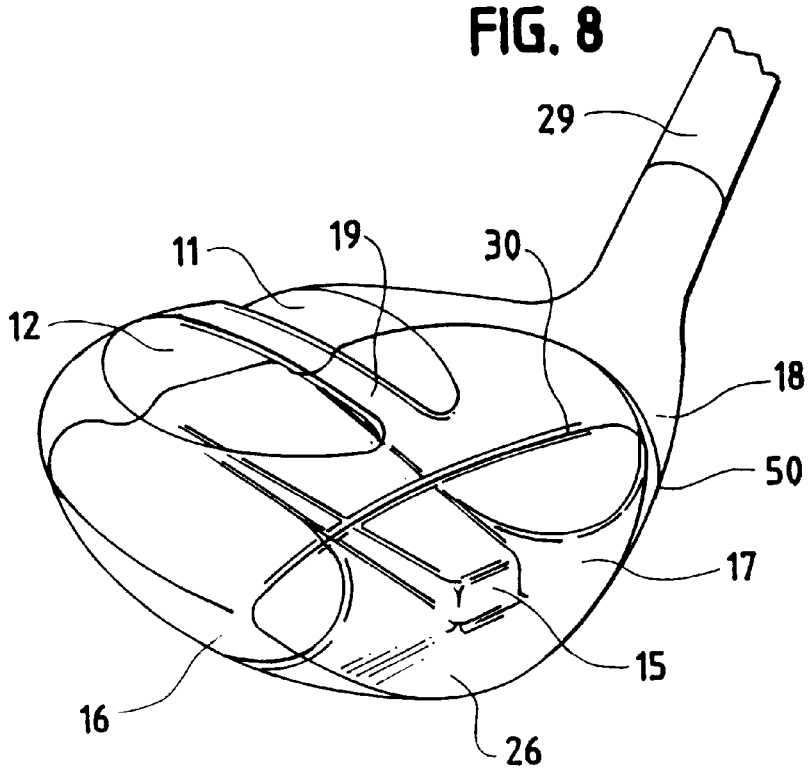
FIG. 8 is a perspective view of the tri-vortex preferred embodiment of the present invention adapted to fairway sized and/or more streamlined configurations eliminating structural weakness at or about limited toe area surfaces, yet providing the integrity of the forward force focus inherent to the present invention.

FIGS. 7 and 8 illustrate the preferred locations of the vortex generators or indentations as incorporated into additional preferred configurations of the present invention in its simplified expression to accommodate smaller, higher-lofted and more naturally streamlined golf club wood heads, wherein the integrity of the forward force and weight distribution advantages, the substance of the present invention, are essentially maintained, thereby eliminating potential structural weakness at or about limited toe area surfaces. While substantially similar, the depth, dimension, and location of the vortex generators or indentations in this art may vary according to the aerodynamic response preferred.

FIG. 7 shows a perspective view of golf club wood head 70 illustrating the primary elements of the crown 69, toe 66, and sole or underside 76 containing vortex generators 61, 63 and 65 along and embedded within the outer perimeter of the golf club wood head 60. Also shown is crestline 70, striking face 67, and shaft 74.

FIG. 8 shows a perceptive view of golf club wood head 80 illustrating the primary elements of the crown 89, sole or underside 96, and an extreme example of minimized, limited toe 86 area surface, wherein consequently vortex generators or indentations 81, 82, and 85 are embedded into the crown 89 and sole or underside 96 along the outer perimeter of golf club wood head 80. Also shown is crestline 90, striking face 87, and shaft 94.

FIGS. 7 and 8 follow the same laws or aerodynamics as expressed in FIG. 6 of the present invention, the harmonious harnessing of aerodynamic forces acting positively on such a designed golf club during an accurate golf downswing.

Figure 9:
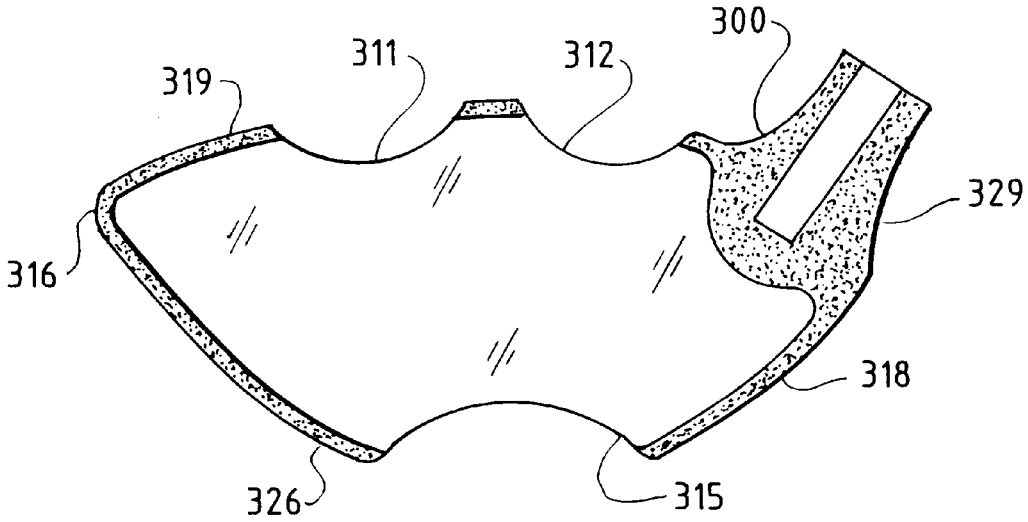
FIG. 9 is a center cross section from shaft to toe of a metal shell embodiment of the present invention showing an acrylic insert within a metal shell or exterior for durability.
Figure 10:
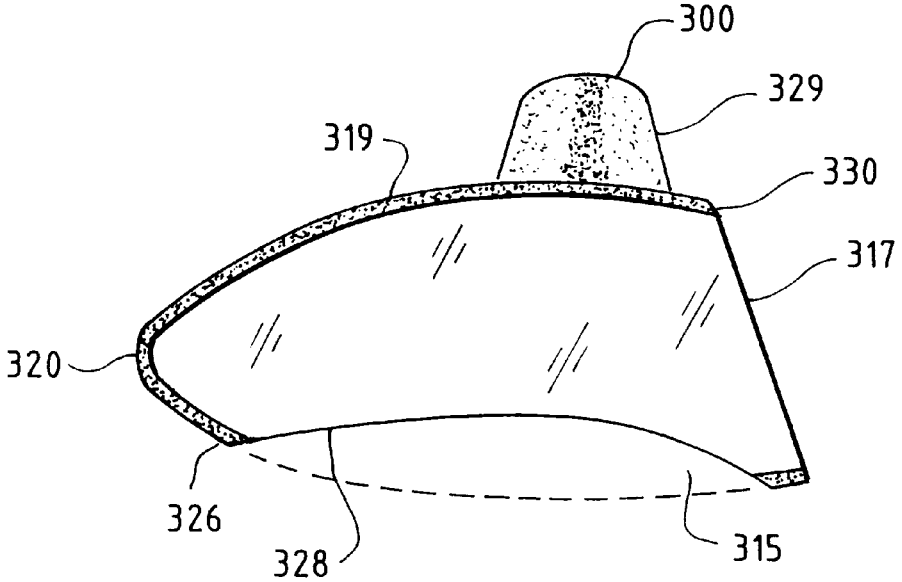
FIG. 10 is a center cross section from striking surface to rear of the metal shell embodiment of the present invention showing an acrylic solid body interior within a metal shell or exterior for durability.
Figure 11:
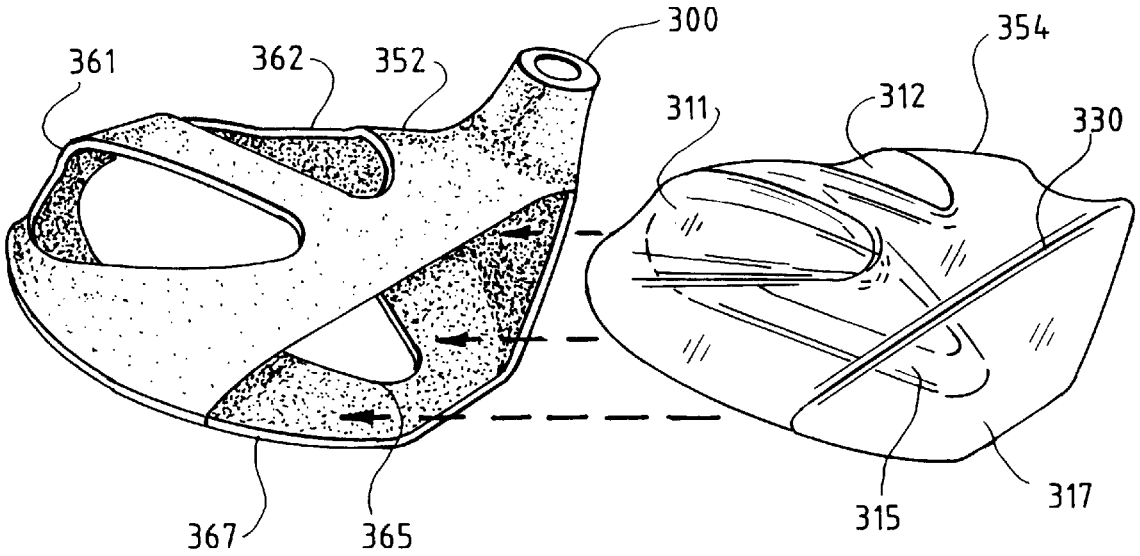
FIG. 11 is an exploded view of another preferred embodiment depicting the solid body acrylic interior completely filling the entire core of the lightweight metal alloy shell, yet providing for the continuance of the vortice embedment depth.

Yet another preferred embodiment is shown in FIGS. 9 to 11 wherein a solid body acrylic interior, which is particularly adept at quickly storing and releasing potential energy during a golf ball strike, is combined with the durability and scratch resistance of metal and metal alloys. FIG. 9 shows a center cross section of golf club wood head 300 which extends from shaft mounting area 329 to toe 316. Golf club wood head 300 is a two piece construction consisting of shell or metal exterior 352 and solid body acrylic interior 354. In this particular configuration, two vortex generators are implemented in crown 319, crown vortex generators 311 and 312. In the sole or underside 326, there is implemented only one underside vortex generator 315.

FIG. 10 shows back or rear 326 of golf club wood head 300, as well as crestline 330, striking face 317 and it further illustrates the open terminal end 328 of underside vortex generator 315.

FIG. 11 illustrates the construction of shell or metal exterior 352 which is outfitted with crown vortex generator openings 361 and 362 in crown 319, as well as underside vortex generator opening 365 located in underside or rear 316. Also provided in shell or metal exterior 352 is a striking face opening 367. Golf club wood head 300 is also conventional in nature and is provided with heel 318 and back or rear 320.

It is anticipated that shell or metal exterior 352 is made from a high strength metal alloy such as a steel, titanium or aluminum alloy or a graphite compound. The acrylic insert 352 thus completely fills the interior of shell or metal exterior 352, yet accommodates the openings of the vortex generating means as shown in FIG. 12.

The assembly of the golf club wood head with a metal exterior occurs as follows. First, the shell or metal exterior 352 snaps into one side of a large liquid or air cooled mold which is cut specifically to accommodate the shell or metal exterior 352. Then both sides of the mold will close mechanically, completely encapsulating shell or metal exterior 352, after which a gate in the interior of the mold opens either at the open face, or more preferably, at one of the vortex generating means openings. It is through this gate that molten acrylic is shot into the shell or metal exterior 352 at approximately 5,200 psi of injection pressure thereby completely filling the shell or metal exterior 352 from the bulge-and-roll of the striking face 317 to the gently curved indentations of vortex generating means in the crown, 311 and 312, as well as underside vortex generator 315. After the mold cavity becomes completely filled with liquid acrylic, the injection gate closes, upon which very gentle and gradual cooling of the mold is accomplished while finished product golf club wood head 300 remains inside the molding housing until the core temperature of the mold is very substantially reduced. At this point, the mold housing may be opened to reveal completed golf club wood head 300 with a high strength metal alloy shell or exterior 352 molded complete with solid body acrylic interior 354 contained therein. The finished product is then removed from the mold for further gentle cooling processes.

Figure 12:
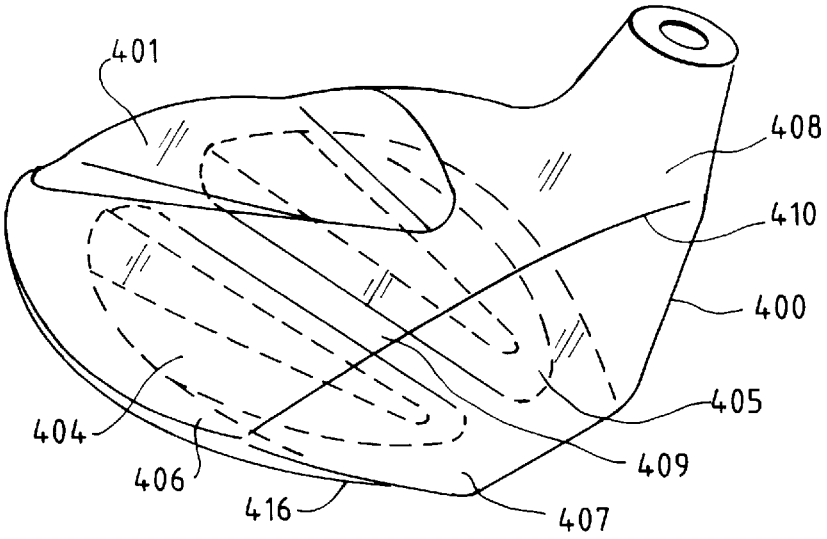
FIG. 12 is a front perspective view of a preferred embodiment of the present invention with a single crown vortex generator and two sole generators.

FIG. 12 shows a perspective view of a more streamlined golf club wood head molded entirely from a polymeric material such as polymethyl methacrylate, or acrylic, golf club wood head 400, featuring now a single very substantial v-shaped vortex generator 401 represented as an indentation embedded into crown 409 of golf club wood head 400, with the two sole or bottom vortex generators 404 and 405 in sole or underside 416 indicated through the clear acrylic club head body. Also shown are crestline 410, striking face 407, heel 408, and toe 406, which is not provided with any vortex generators.

Figure 13:
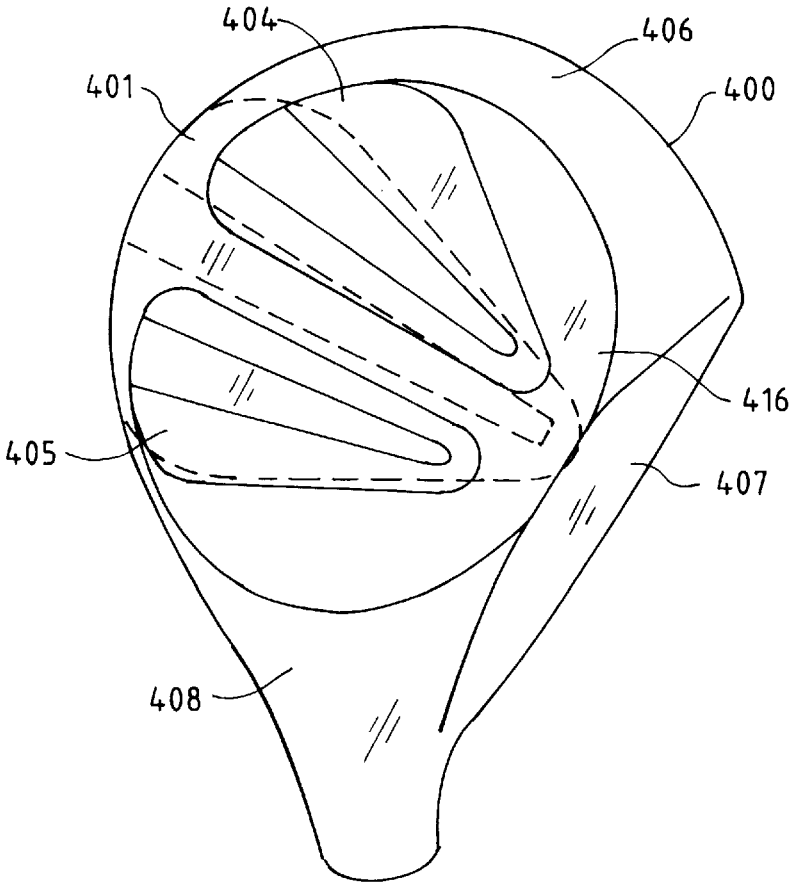
FIG. 13 is a bottom plan view of a preferred embodiment of the present invention with a single crown vortex generator and two sole generators.

FIG. 13 shows a bottom perspective view of the golf club wood head depicted in FIG. 12 featuring the two sole or bottom vortex generators 404 and 405 in sole or underside 416 represented as indentations embedded therein, with the single crown or top vortex generator 401 indicated through the clear acrylic club wood head 400.

Figure 14:
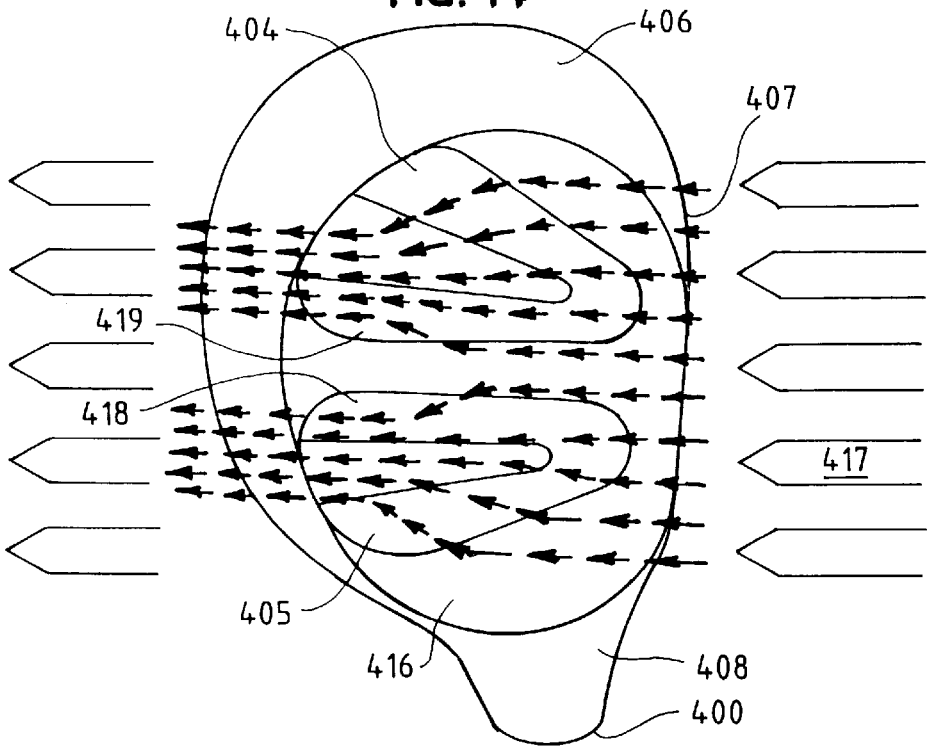
FIG. 14 is a bottom plan view of a preferred embodiment of the present invention with a single crown vortex generator and two sole generators showing air flow post the underside or sole of the golf club wood head.

FIG. 14 shows a bottom perspective view of the golf club wood head 400 depicted in FIGS. 12–13 illustrating the laws of fluid dynamics in physics wherein the forces and moments of the static and dynamic stability of fluid air are dramatized as golf club wood head 400 moves on an arcuate golf downswing plane, showing the disruption of the static stability of air at the leading edge or striking surface 407 converting the static stability into dynamic stability, forcing the pressurized fluid air molecules around, and as depicted as air flow intake 417 in this figure, under the golf club wood head 400, forming at the surface a boundary layer of air which is abruptly interrupted at the very beginning of the indentations of sole or bottom vortex generators 404 and 405 located just behind the leading edge or striking surface 407 therein creating a significant vacuum of now faster moving air drawn into the depths of both sole vortex generators 404 and 405, redirecting the more rapidly moving air rearwardly though both vortex generators 404 and 405 and out the open terminal ends 418 and 419 at the back of golf club wood head 400, keeping in mind, and most importantly, that as a direct result of the flare outwardly toward the toe and heel of the club head body 400 of the v-shaped vortex generators 404 and 405, the air boundary layer is disrupted all along the flare outwardly, thereby creating a virtual continuum of vacuum or vortex generation from the very beginning of the indentations in vortex generators 404 and 405 located just behind the leading edge or striking surface 407 and continuing across the vortex lines flaring towards the toe 406 and heel 408, causing a continuous increase of air movement into and through both vortex generators 404 and 405 with the greatest and fastest moving air passing out the rearward open terminal ends 418 and 419, thereby creating the maximum of lift and thrust, after which the static stability of air returns.

FIG. 14 is a top plan view of the same club head, golf club wood head 400 which is depicted in FIGS. 12–13 wherein the forces and moments of the static stability and dynamic stability of fluid are depicted as golf club wood head 400 moving on an arcuate golf down swing plane, indicating the disruption of the static stability of air at the leading edge or striking surface 407, converting the static stability into pressurized dynamic stability, forcing the fluid air molecules around and, most especially, over the crown 409 or top of the golf club wood head 400, forming at the surface a boundary layer of intake air 417 which is abruptly disrupted at the very beginning of the indentation of the large, single vortex generator 401 located just behind the leading edge or striking surface 407, or face, therein creating a vacuum of now faster moving air drawn into the depth of the crown vortex generator 401, redirecting the more rapidly moving air rearwardly out the open terminal end 420 at the back of the golf club wood head 400, once again realizing most importantly, that the direct result of the dramatic flare outwardly toward the toe 406 and heel 408 of the very substantially v-shaped single crown vortex generator 401, the air boundary layer is disrupted all along the v-shaped flare outwardly, again creating a virtual continuum of vacuum or vortex generation from the very beginning of the single crown indentation centrally located just behind the leading edge or striking surface 407 and continuing across the vortex lines extending toward the toe 406 and heel 408 of golf club wood head 400 and again causing a continuum of increased air movement into and through the crown vortex generator 401 with the greatest and most rapidly moving air passing out the open terminal end at the back of golf club wood head 400, thereby creating the maximum of lift and thrust, after which the static stability of air returns.

Figure 15:
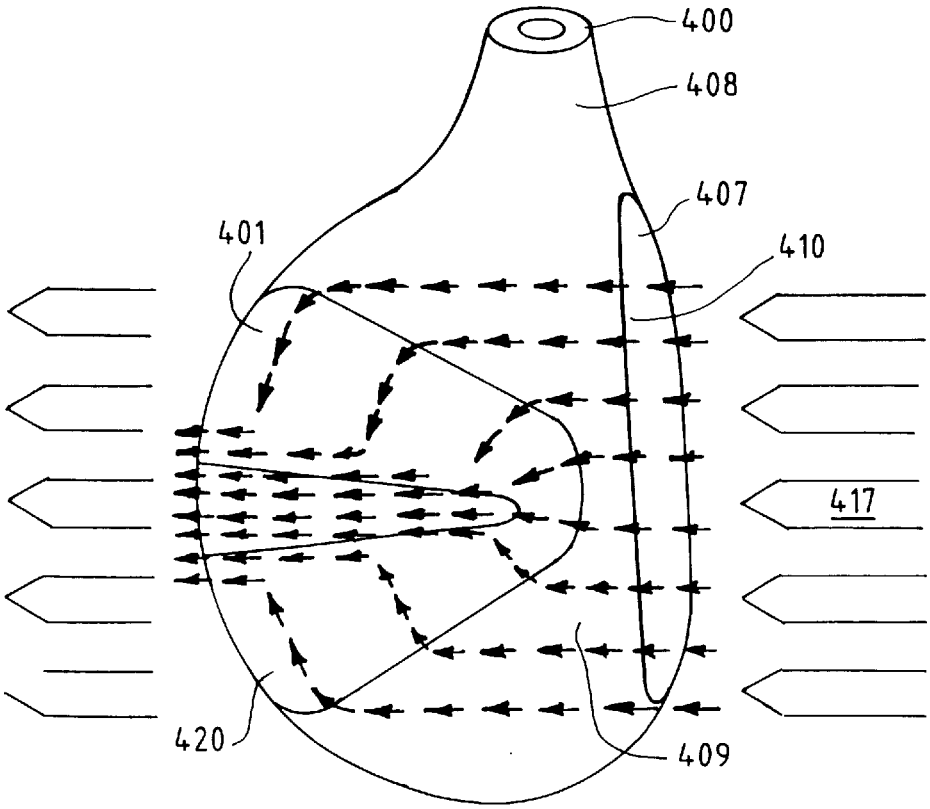
FIG. 15 is a top plan view of a preferred embodiment of the present invention with a single crown vortex generator and two sole generators showing air flow past the top or crown of the golf club wood head.
Figure 16:
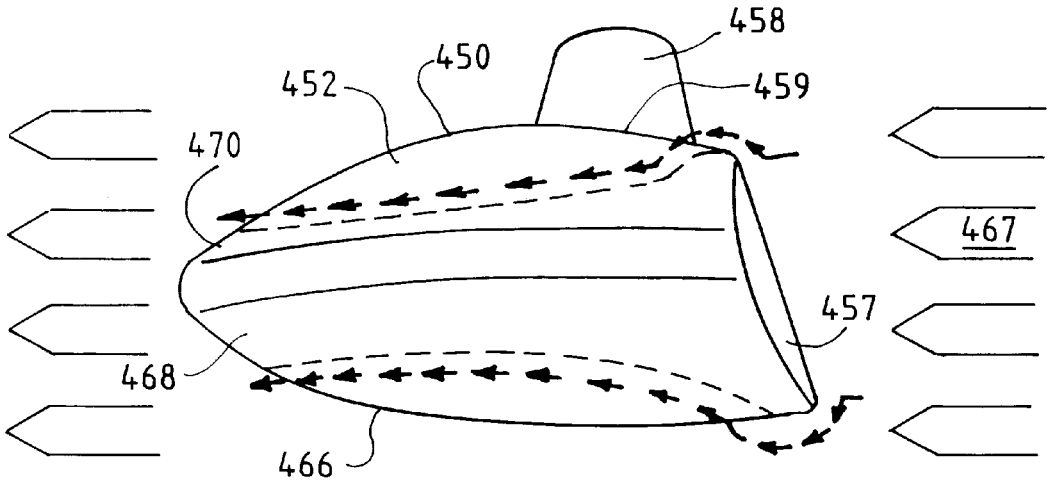
FIG. 16 is an end plan view of a smaller fairway wood version of the present invention, showing air flow over the crown and sole of fairwood head that cannot accommodate toe vortices head.

FIG. 16 is an end plan view of a more streamlined golf club putter head 450 having at least one vortex generator 451 located in the top or crown 459, and one vortex generator 455 located in the sole or underside 466. In this particular embodiment of a putter club head 450, there is a second vortex generator 452 located in the top or crown 459. This embodiment of vortex locations is similar in nature, but not limited to the various configuration of vortex generating means presented thus far in various figures, indicating a golf club putter head 450 moving on an arcuate golf downswing plane and indicating the aerodynamic response of the intake air 467 the golf club putter head 450 moves through, converting static stability into pressurized dynamic stability, utilization of the maximum of lift and thrust, therefore creating the maximum forward force focus, and finally the return of the static stability of air once the golf club putter head 450 has passed through it as heretofore described extensively in FIGS. 14 and 15.

Figure 17:
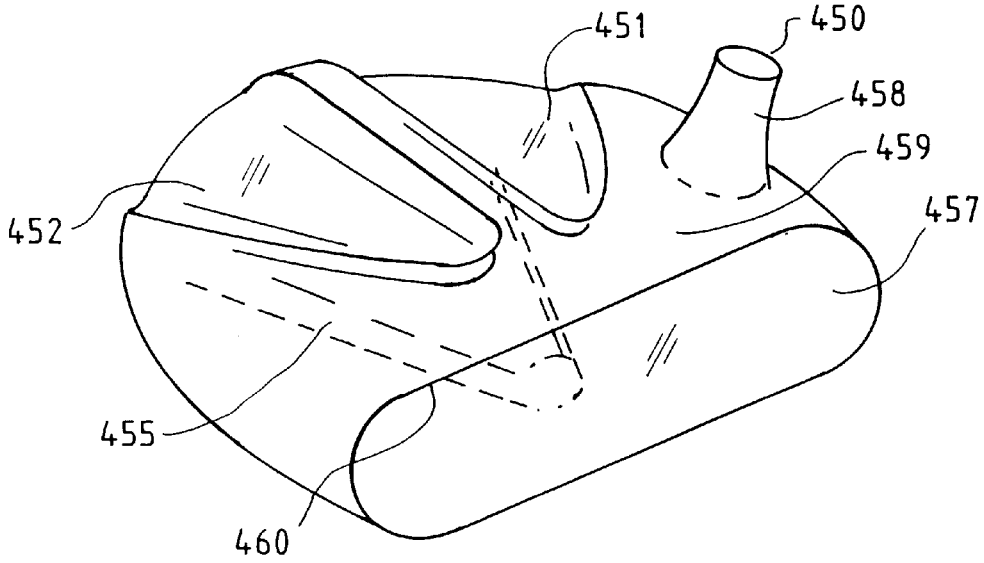
FIG. 17 is a front perspective view of a putter version of the present invention.

FIG. 17 is a perspective view of the golf club putter head 450 illustrating two vortex generators 451 and 452 located in the top or crown surface, with only a single, large vortex generator 455 located in the sole or underside 466. This preferred embodiment illustrates the fact that although a putter generally moves at a dramatically slower speed than a wood type of golf club, such a putter design will still take very substantial advantage of the multiple vortex generator configuration.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A golf club head comprising:

a club body;

said club body having a ball striking surface, a crown surface, a toe surface, a rear surface, a heel surface, and an underside surface;

at least one vortex generating means having a gently curving aerodynamic configuration capable of inducing a force against the club head surface wherein each vortex generating means located within each of the crown and underside surfaces, extend rearwardly from just behind a plane containing the ball striking surface;

at least one of the vortex generating means in the crown surface which flares outwardly toward the heel and surfaces as it extends towards the rear of the club head body and having an open terminal end adjacent the rear surface of the club head body and is dimensioned to produce net lift and thrust during a golf swing;

at least one of the vortex generating means in the underside surface is located substantially centrally between the heel and toe surfaces and the vortex generating means flares outwardly toward the heel and toe surfaces as it extends towards the rear surface of the club head body and having an open terminal end adjacent the rear surface of the club head body and is dimensioned to produce net lift and thrust during a golf swing;

and each of the vortex generating means in the crown and the underside surfaces are substantially equal in depth along their respective lengths;

whereby the aerodynamic forces created by the vortex generating means in the crown and underside surfaces create a net lift and thrust during a golf swing.

2. The golf club head according to claim 1 wherein at least one vortex generating means in the underside is substantially v-shaped.

3. The golf club according to claim 1 wherein at least one vortex generating means in the crown is substantially v-shaped.

4. The golf club head according to claim 1 wherein the golf club head has an outer metal shell and is further provided with an interior polymeric insert adapted to fit within the outer metal shell.

5. The golf club head according to claim 4 in which the insert is made from acrylic.

6. The golf club head according to claim 4 wherein there is at least one vortex generating means positioned in the toe surface.

7. The golf club head according to claim 1 wherein there are at least two vortex generating means positioned in the crown surface.

8. The golf club head according to claim 1 wherein there is one vortex generating means positioned in the underside surface.

9. A golf club wood head comprising:

a club head body comprising an interior solid body insert and an outer metal shell adapted to fit and retain the solid body insert;

said club head body having a ball striking surface, a crown surface, a toe surface, a rear surface, a heel surface, and an underside surface with at least one of said surfaces containing at least one vortex generating means having a gently curving aerodynamic configuration capable of inducing a force against the club head surface wherein the at least one vortex generating means extends rearwardly from just behind a plane containing the ball striking surface and has an open terminal end adjacent the rear surface of the club head body;

said outer metal shell being outfitted with at least one opening for defining said at least one vortex generating means;

said solid body insert substantially filling the interior of the outer metal shell while accommodating the at least one opening defining the vortex generating means.

10. The golf club head according to claim 9 in which the solid body insert is made from either acrylic or other polymeric substance.

11. The gold club head according to claim 9 in which the outer metal shell is made from high strength titanium alloy or other metal alloy.

* * * * *